US007762628B2

(12) United States Patent
Williams

(10) Patent No.: US 7,762,628 B2
(45) Date of Patent: Jul. 27, 2010

(54) LOUNGE CHAIR COVER

(76) Inventor: Benjamin Jacob Williams, 117 Prison St., Lahaina, HI (US) 96761

( * ) Notice: Subject to any disclaimer, the term of this patent is extended or adjusted under 35 U.S.C. 154(b) by 56 days.

(21) Appl. No.: 11/852,230

(22) Filed: Sep. 7, 2007

(65) Prior Publication Data

US 2009/0001790 A1 Jan. 1, 2009

Related U.S. Application Data

(60) Provisional application No. 60/824,886, filed on Sep. 7, 2006.

(51) Int. Cl.
*A47C 31/10* (2006.01)

(52) U.S. Cl. ..... 297/229; 297/228.1

(58) Field of Classification Search ..... 297/219.1, 297/228.1, 228.12, 229
See application file for complete search history.

(56) References Cited

U.S. PATENT DOCUMENTS

| | | | | | |
|---|---|---|---|---|---|
| 1,619,556 | A * | 3/1927 | Aaron | 297/228.1 |
| 2,202,065 | A * | 5/1940 | Peebles | 297/229 |
| 4,518,198 | A * | 5/1985 | Daniels | 297/229 |
| 4,536,028 | A * | 8/1985 | Jones et al. | 297/224 |
| 4,892,353 | A * | 1/1990 | Goddard | 297/224 |
| 5,275,463 | A * | 1/1994 | Rocha | 297/229 |
| 5,441,789 | A * | 8/1995 | Walker | 297/229 |
| 6,079,778 | A * | 6/2000 | Lindberg | 297/223 |
| 6,626,491 | B1 * | 9/2003 | Blome et al. | 297/229 |
| 7,231,677 | B1 * | 6/2007 | Reeves | 5/419 |

* cited by examiner

*Primary Examiner*—Peter R. Brown
(74) *Attorney, Agent, or Firm*—Michael Ries

(57) ABSTRACT

The present invention provides a lounge chair cover comprising a substantially-rectangular, typically absorbent, textile sheet and adjustable fasteners at the four corners of the textile sheet.

8 Claims, 4 Drawing Sheets

Fig. 3
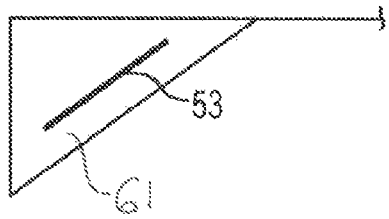
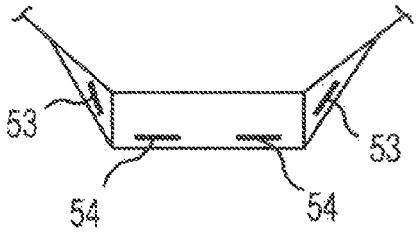
Fig. 4
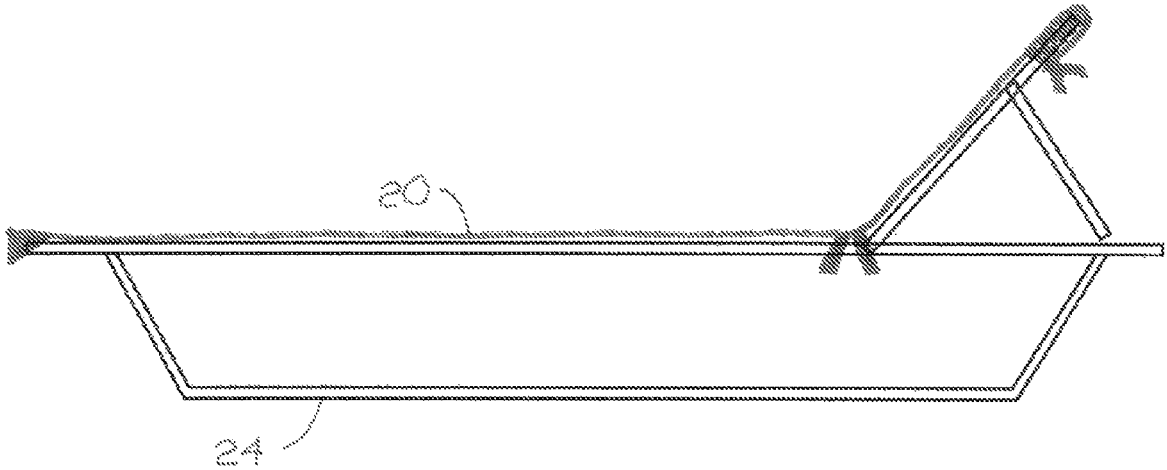
Fig. 5

LOUNGE CHAIR COVER

RELATED APPLICATION

This application claims the benefit of U.S. provisional patent application Ser. No. 60/824,886, filed on 7 Sep. 2006, for an invention entitled, "Lounge Chair Cover".

BACKGROUND OF THE INVENTION

1. Field of the Invention

The present invention is directed to removable chair covers, especially covers for outdoor chairs such as lounge chairs and boating chairs.

2. Description of the Related Art

Users of chairs deployed near bodies of water, chairs used after engaging in watersports or bathing, and chairs used in connection with spas and hot springs (collectively, "watersports environments"), often benefit from chair covers that absorb water or perspiration from a chair user's body. In this application, (1) "lounge chair" means a chair that has one or more horizontal (or near horizontal) planar members upon which a user can lie (typically supine or prostrate), and typically includes a back member that can lie flat or be inclined about a first hinge to support the back of a seated user, and may include a front member that can lie flat or be declined about a second hinge to support the legs of a user, (2) "boating chair" means a chair that has a shorter horizontal (or near horizontal) planar member on which a user sits, similar to that of a table chair, that has a fixed back, and optionally is collapsible, (3) "chair cover" means an textile, typically absorbent, disposed between the user of a chair and the surface of a chair, and which is removably attached to the chair, (4) "both types of chairs" means lounge chairs and boating chairs, collectively, and (5) "chair frame" means the structural elements of a chair, such as frames, cross-members, legs, and other elements that indirectly or directly support the weight of a chair user. Examples of lounge chairs are, inter alia, deck chairs, chaises longues, lawn chairs, and pool chairs. Examples of boating chairs are, inter alia, folding chairs, picnic chairs, card table chairs, and table chairs. Folding boating chairs typically have a chair back hinged to a chair seat, provide only one chair back position when in use, and lack a hinged chair foot. The forward part of a chair is that part anterior to a user in sitting position. The rear part of a chair is the part posterior to the user in a sitting position.

Many embodiments of lounge chairs have a rear hinge that permits a rear planar section (the chair back of the lounge chair, called herein the "back member" when referring to lounge chairs, and "chair back" when referring to both types of chairs) to be pivoted upward from horizontal to support a user's back and, in many lounge chair designs, the chair back is long enough to support a user's head. Some embodiments of lounge chairs have a forward hinge that permits a foot planar section (called herein the "chair foot") to be pivoted downward from horizontal. Both types of chairs are typically constructed with wood, plastic, or metal frames; plastic and metal frame materials are typically L-shaped or hollow channel, e.g., extruded plastic or aluminum, and joined by fasteners, welding, adhesives, and other methods known in the art. Lounge chairs may provide detents for various angles of inclination of the back member and of declination of the chair foot. The portions, e.g., cross-members or interlaced members, of the chair back and chair seat (and chair foot, in the case of lounge chairs), i.e., the portions that support a user, of both types of chairs, especially those made with plastic or metal frames, are typically constructed with straight, interlaced, or interwoven bands of plastic or textile (collectively, and for convenience, "seating material", even though "seating material" is technically a misnomer as to the chair back). "Chair head" means the upper, terminal portion of a chair back. The head and foot of a chair cover correspond, when the cover is fitted to a chair, to the rear and forward parts of the chair frame.

Both types of chairs can be fitted with a chair cover to minimize a user's discomfort from contact with the seating material and to absorb perspiration or water. Absorbent chair covers are preferred to towels placed on a chair, since chair covers remain in place despite wind and user movements. The means of attachment of chair covers to both types of chairs generally takes one of two approaches: (1) fasteners on the chair cover that mate with fasteners on the chair or fasteners on a corresponding portion of the chair cover wrapped around a frame member, and/or (2) pockets at the head and foot of the chair cover that envelope the rear and forward ends, respectively, of the chair frame. A long-standing and unsolved technical problem in chair cover design is to provide a means of attaching a single chair cover alternately (1) to a chair that has a section of frame and seating material protruding beyond the point of attachment of the front legs of the chair or equivalent substructure (i.e., protruding forward of the point of attachment of the front legs of the chair to the chair foot in the case of a lounge chair, and to the forward part of the chair seat in the case of a boating chair) and has a section of frame and seating material protruding beyond the point of attachment of the chair back to the rear chair legs (or equivalent substructure), and (2) to a chair that does not have a section of frame and seating material protruding beyond the point of attachment of the front legs of the chair or equivalent substructure (e.g., a lounge chair in which the front legs are attached to the forward end of the chair frame) and/or does not have a section of frame and seating material protruding beyond the point of attachment of the chair back (or protruding beyond the point of attachment of the chair back to the rear chair frame, in the case of a lounge chair with hinged back member) to the rear chair legs (or equivalent substructure). One possible equivalent substructure for chair legs is a sled-style base. Hereafter, all structures for elevating a chair above ground level, and for supporting the back of a lounge chair with a hinged back member, are called "legs". For convenience, the support (usually pivoted) of a lounge chair back is included in the term "rear chair leg". The "top" of the chair cover is the surface of the chair cover in contact with the user. The "bottom" of the chair cover is opposite the top surface.

U.S. Pat. No. 4,877,288 to Lee, U.S. Pat. No. 4,536,028 to Jones, and U.S. Pat. No. 4,832,353 to Goddard disclose a lounge chair cover that uses close-fitting, preformed pockets in the head and foot of the chair cover to fit over the protru ding forward and rear frame ends, respectively, of a lounge chair. The chair cover designs of Lee, Jones, and Goddard cannot be attached to a lounge chair that lacks frame ends protruding from the forward and rear points of attachment of the legs of the chair; the preformed pockets in the chair cover designs of Lee, Jones, and Goddard are blocked from enveloping the frame ends by the attachment of the chair legs to the ends of the frame. Many types of lounge chairs, particularly wooden and plastic lounge chairs, do not have frame ends protruding from the forward and rear points of attachment of the chair legs; in such designs, the attachment of the chair legs is to the very ends of the chair frame, and pre-formed pockets cannot be attached.

Ease and speed of removal of chair covers are a second set of technical problems in chair cover design. A resort hotel may have hundreds of chair covers in use at a time, all of which must be periodically, often daily, removed and laundered.

There is an unmet need for a chair cover that can be attached to both types of lounge chairs (i.e., lounge chairs that have chair frame protruding beyond the forward and rear points of attachment of the chair legs, and those that do not) and for a chair cover that can be attached to both types of boating chairs (i.e., boating chairs that have chair frame protruding beyond the forward and rear points of attachment of the chair legs, and those that do not), yet be easily and quickly removed.

SUMMARY OF THE INVENTION

To solve the technical problems presented above, the present invention provides, in a first, basic embodiment, a lounge chair cover comprising a substantially-rectangular, typically absorbent, textile sheet and adjustable fasteners at the four corners of the textile sheet. Each "adjustable fastener" comprises a small, substantially triangular sheet of elastic textile attached along the longitudinal margin of a given corner of the textile sheet, a hook-and-loop fastener affixed near the bottom edge of the medial surface of the elastic textile, a mating hook-and-loop fastener affixed on the edge of the bottom lateral surface of the end of the textile sheet at such corner disposed so as to engage the hook-and-loop fastener on the medial face of the elastic textile, and the portion of the main textile sheet associated with the latter fastener; two of which adjustable fasteners at the head or foot of the chair cover create paired brackets that conform the head or foot, respectively, of the textile sheet into an L shape. Each adjustable fastener installs on a chair by draping the L-shaped head and foot of the chair cover over the corresponding rear and forward ends of the chair, and engaging the hook and loop fasteners at each corner; if a chair leg (or back support leg, in the case of the back member of a lounge chair) is present at the corner, the hook and loop fasteners at that corner are engaged so as to wrap the chair leg at that corner within the textile sheet and the elastic textile; if no chair leg is present, engagement of the fasteners transforms each L-shaped end of the textile sheet into a chair cover head pocket and a chair cover foot pocket that envelopes the rear and forward, respectively, ends of the chair frame. The chair cover is removed by disengaging the hook and loop fasteners at each corner. Embodiments of the invention, with adjustable fasteners at each of the corners and sized for given chair dimensions, are easily installed on, and removed from, lounge chairs and boating chairs, whether or not the chair has a frame protruding at the beyond the point of attachment of the forward and rear legs of the chair. The length and width of the textile sheet are cut and assembled as described herein to fit a given type of chair, either lounge chair or boating chair.

In a second embodiment of the invention, for use when a frame end protrudes from one point of attachment of legs to a lounge chair or boating chair, but not from the opposite end, adjustable fasteners are used at the two corners at one end of the textile sheet and another means of attachment, e.g., a preformed pocket, is used at the opposite end. A typical application of this embodiment is for lounge chairs and boating chairs that have a rear frame protruding from the point of attachment of the rear legs, but the forward legs are attached to the chair frame at the very end of the chair foot or chair seat, respectively. In such an application, a preformed pocket is typically used to attach the head of the chair cover to the chair back, and the adjustable fasteners are used to attach the opposite end of the chair cover. The length and width of the textile sheet in this second embodiment are cut and assembled as described herein to fit a given type of chair, either lounge chair or boating chair.

A typical dimension for a lounge chair cover of the invention is 28" wide and 92" long. A typical dimension for a boating chair cover of the invention is 22" wide and 44" long. The elastic brackets of the invention are approximately right triangles in which the sides are approximately of equal length, from 3" to 6" long. Other triangular shapes, and even polygonal and curvilinear shapes, can be used for the elastic bracket. A hook-and-loop fastener segment on an elastic bracket is typically 1" wide and nearly as long as the edge of the elastic triangle nearest the segment, as shown in the Drawings. A hook-and-loop fastener segment on a lateral edge is typically 1" wide and 2" long.

BRIEF DESCRIPTION OF THE DRAWINGS

FIG. 3 shows an internal side view of an adjustable fastener (foot of chair cover, right side), not attached to a lounge chair;

FIG. 4 shows an internal end view of the foot of a chair cover not attached to a lounge chair;

FIG. 5 shows a side view of an adjustable fastener (foot of chair cover, left side) attached to a lounge chair with protruding frame;

DETAILED DESCRIPTION OF THE PREFERRED EMBODIMENTS

Figure 1:
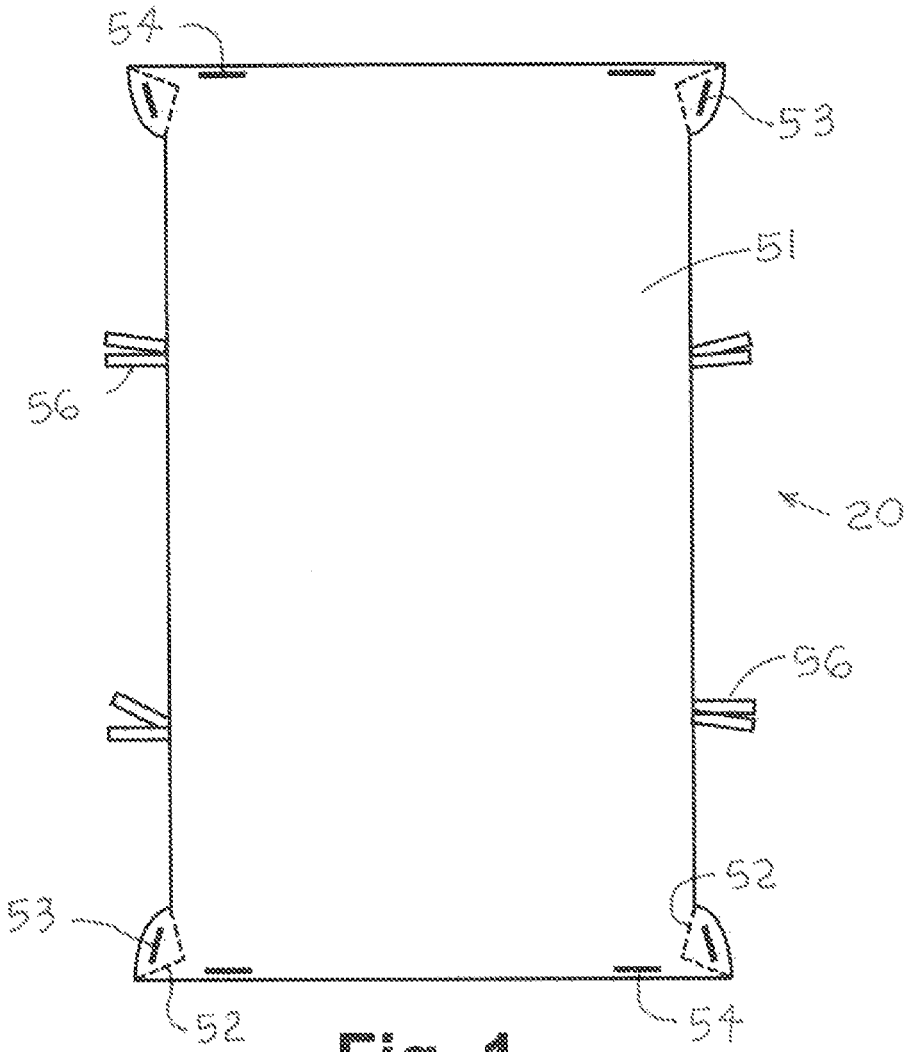
FIG. 1 shows a bottom plan view of the invention in an embodiment of a lounge chair and with optional middle tabs.

As shown in FIG. 5, the present invention provides, in one embodiment, a lounge chair cover 20 comprising a substantially-rectangular, textile sheet ("main sheet") (51) and an adjustable fastener at each of the four corners of the textile sheet. For use in watersports environments, the main sheet is typically made of absorbent, woven or non-woven, textile, such as terrycloth. Each adjustable fastener comprises a small, substantially triangular sheet of elastic textile ("elastic bracket") (52) attached along the longitudinal margin of a given corner of the main sheet, a hook-and-loop fastener (53) affixed near the bottom edge of the medial surface of the elastic bracket 52, a mating hook-and-loop fastener (54) affixed on the edge of the bottom surface of the end of the main sheet at such corner disposed so as to engage the hook-and-loop fastener on the medial face of the elastic bracket 52, and the portion of the main sheet associated with the latter fastener. The two adjustable fasteners at the head or foot of the chair cover create paired brackets that conform the head or foot, respectively, of the main sheet (seen along the central, longitudinal axis) into an L shape prior to installation of the chair cover 20 on a chair 22, shown in FIG. 2. Each adjustable fastener installs on a chair by draping the L-shaped head and foot of the chair cover over the corresponding rear and forward ends of the chair, and engaging the hook and loop fasteners at each corner; if a chair leg (or back support leg, in the case of the back member of a lounge chair) is present at the corner, the hook and loop fasteners at that corner are engaged so as to wrap the chair leg at that corner within the main sheet and the elastic bracket; if no chair leg is present, engagement of the fasteners transforms each L-shaped end of the main sheet into a chair cover head pocket and chair cover foot pocket that envelope the corresponding rear and forward ends, respectively, of the chair frame. The chair cover is removed by disengaging the hook and loop fasteners at each corner and lifting the cover off the chair. This embodiment, with adjustable fasteners at each of the corners of the main sheet and sized for given chair dimensions, is easily installed on, and removed from, lounge chairs and boating chairs, whether or not the chair has a frame protruding beyond the point of attachment of the forward and rear legs of the chair, thereby solving the technical problems presented above. The length and width of the main sheet are cut and assembled as described herein to fit a given type of chair, either lounge chair or boating chair.

Each triangular sheet of elastic textile (i.e., "elastic bracket", as defined above) is attached to the main sheet by means known in the art of textiles. The preferred method of attachment of an elastic bracket to the main sheet is by sewing; other means of attachment include thermal bonding and adhesives. Non-woven textile techniques can be used to fabricate an integral main sheet and elastic bracket, or to bond a non-woven main sheet with a non-woven elastic bracket, non-woven main sheet and woven elastic brackets, or woven main sheet and non-woven elastic brackets. The elastic bracket has the approximate shape of a right triangle. The right angle of the right triangle of each elastic bracket is attached to the main sheet so that, when viewed from the side, the attached elastic bracket creates an L shape in that end of the main sheet. A first pair of elastic brackets creates an L-shaped end in the one end of the main sheet, and a second pair of attached elastic brackets creates an L-shaped end in the opposite end of the main sheet. The textile used to make an elastic bracket can be any number of stretch fabrics known in the art, such as LYCRA® (Invista Corp., Witchita, Kans. 67220).

As shown in FIG. 3, an elastic bracket (61) has been attached to the forward, left corner of a main sheet, i.e., to the left side of the foot of the chair cover.

A hook-and-loop fastener (53), such as VELCRO® (Velcro Industries, B.V., Amsterdam, NL), is affixed near the edge of the medial surface of the elastic bracket 61. The hook-and-loop fastener 53 affixed on the elastic bracket 61 is typically a strip that is much longer than the corresponding strip of hook-and-loop fastener affixed on the bottom surface of the lateral end of the main sheet that will mate with the strip of hook-and-loop fastener on the elastic bracket. Fasteners used in the invention can be other types, e.g., snaps, button and buttonhole, but hook-and-loop fasteners are preferred since they are adjustable over the complete range of overlap of the fasteners to be mated. The preferred method of attachment of a hook-and-loop fastener to the main sheet and to the elastic bracket is by sewing; other means, such as thermal bonding and adhesives, can be used.

As shown in FIG. 4, a hook-and-loop fastener (54) is affixed on the edge of the bottom surface of a lateral end of the textile sheet at such corner disposed so as to engage the corresponding hook-and-loop fastener (53) on the medial face of the elastic bracket.

FIG. 5 shows a chair cover 20 of the invention installed on a lounge chair 24 that has frame protruding from the points of attachment of the forward and rear chair legs.

Figure 2:
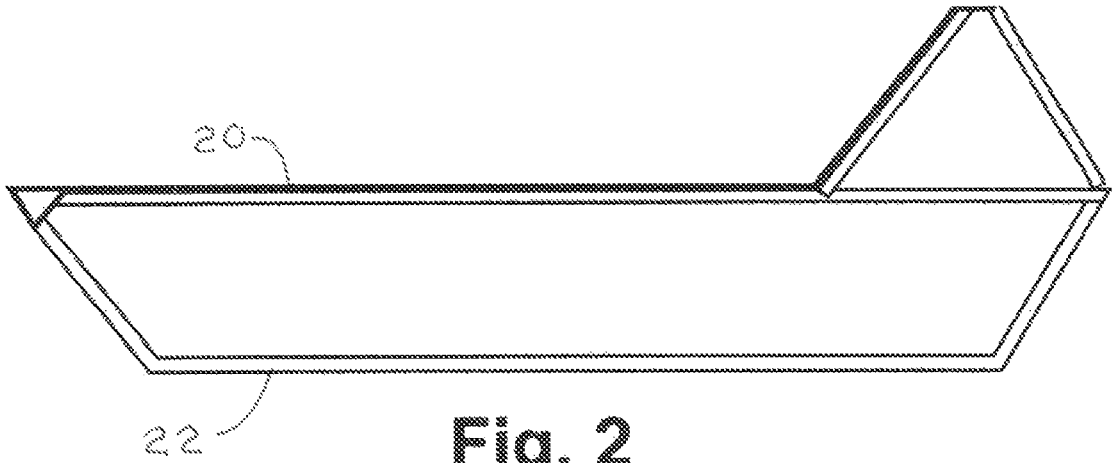
FIG. 2 shows a side view of an adjustable fastener (foot of chair cover, left side), attached to a lounge chair without protruding frame.

FIG. 2 shows a chair cover 20 of the invention installed on a lounge chair 22 that does not have frame protruding from the points of attachment of the forward and rear chair legs.

In some watersports environments, wind gusts are common and the middle portion of a chair cover must be attached to the chair frame to prevent ballooning of the chair cover during a wind gust. Ballooning of the chair cover can transform the chair cover into a sail and render the chair airborne, a dangerous and undesirable event. In such environments, a chair cover with a means for securing the middle portion of the chair cover to the chair frame is desirable. An alternative embodiment of the invention has tabs of fasteners 56 ("tab fasteners") at one or more places along the sides of the middle portion of the chair cover. A preferred fastener is hook-and-loop, though other fasteners known in the art, e.g., tie strings, buttoned strap, snap fasteners, etc., can be used. The tab fasteners at one or more places along the sides of the middle portion of the chair cover are used to secure the chair cover to the chair frame on the left and right sides of the chair.

In a second embodiment of the invention, for use when a frame end protrudes from the points of attachment of chair legs at one end of a lounge chair or boating chair, but not from the opposite end, adjustable fasteners are used at two corners at one end of the main sheet and another means of attachment, e.g., a preformed pocket, is used at the opposite end. A preformed pocket is typically less expensive to make, since the pocket can be formed by folding the textile of the main sheet back upon itself and sewing the longitudinal edges. The mouth of the pocket so formed can be hemmed or unhemmed, gathered or ungathered. If hemmed, the hem can include a channel for a drawstring or can include an elastic strip, both of which are called a "closure means" and enable, or cause, the pocket mouth to be gathered so that the pocket is more tightly secured around a protruding chair frame. A typical application of this embodiment is for lounge chairs and boating chairs that have a chair back with protruding frame, but the chair foot or chair seat, respectively, has legs attached to the chair frame at the very end of the chair foot or chair seat, respectively. In such an application, a preformed pocket is typically used to attach the head of the chair cover to the top of the chair back, and the adjustable fasteners are used to attach the opposite end of the chair cover to the forward end of the chair (in the case of a lounge chair) or forward portion of the chair seat (in the case of a boating chair). The length and width of the main sheet are cut and assembled as described herein to fit a given type of chair, either lounge chair or boating chair.

Figure 6:
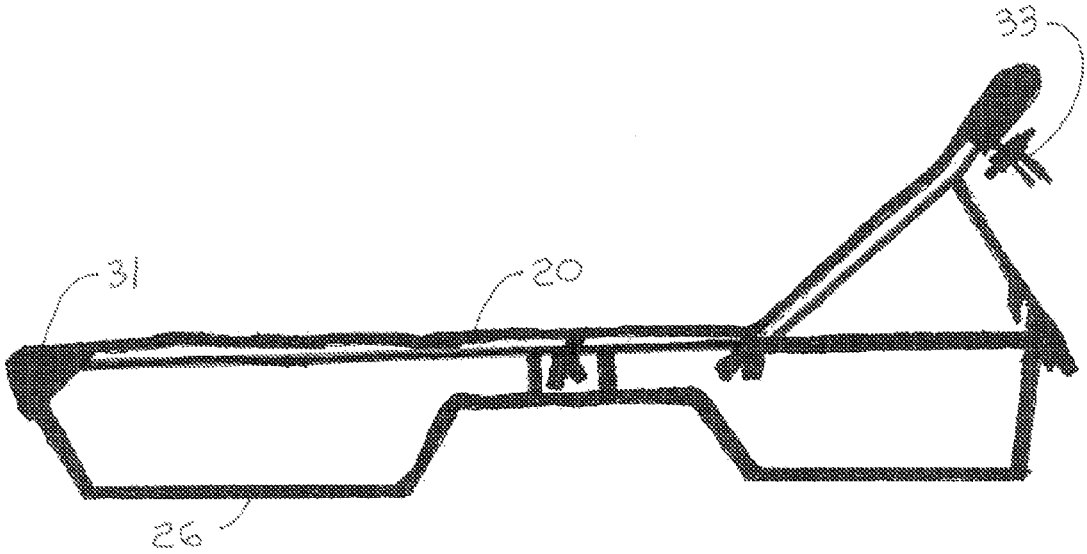
FIG. 6 shows a side view of the invention in an embodiment that has a pocket with drawstring at the head of the chair cover and adjustable fasteners at the foot of the chair cover.
Figure 7:
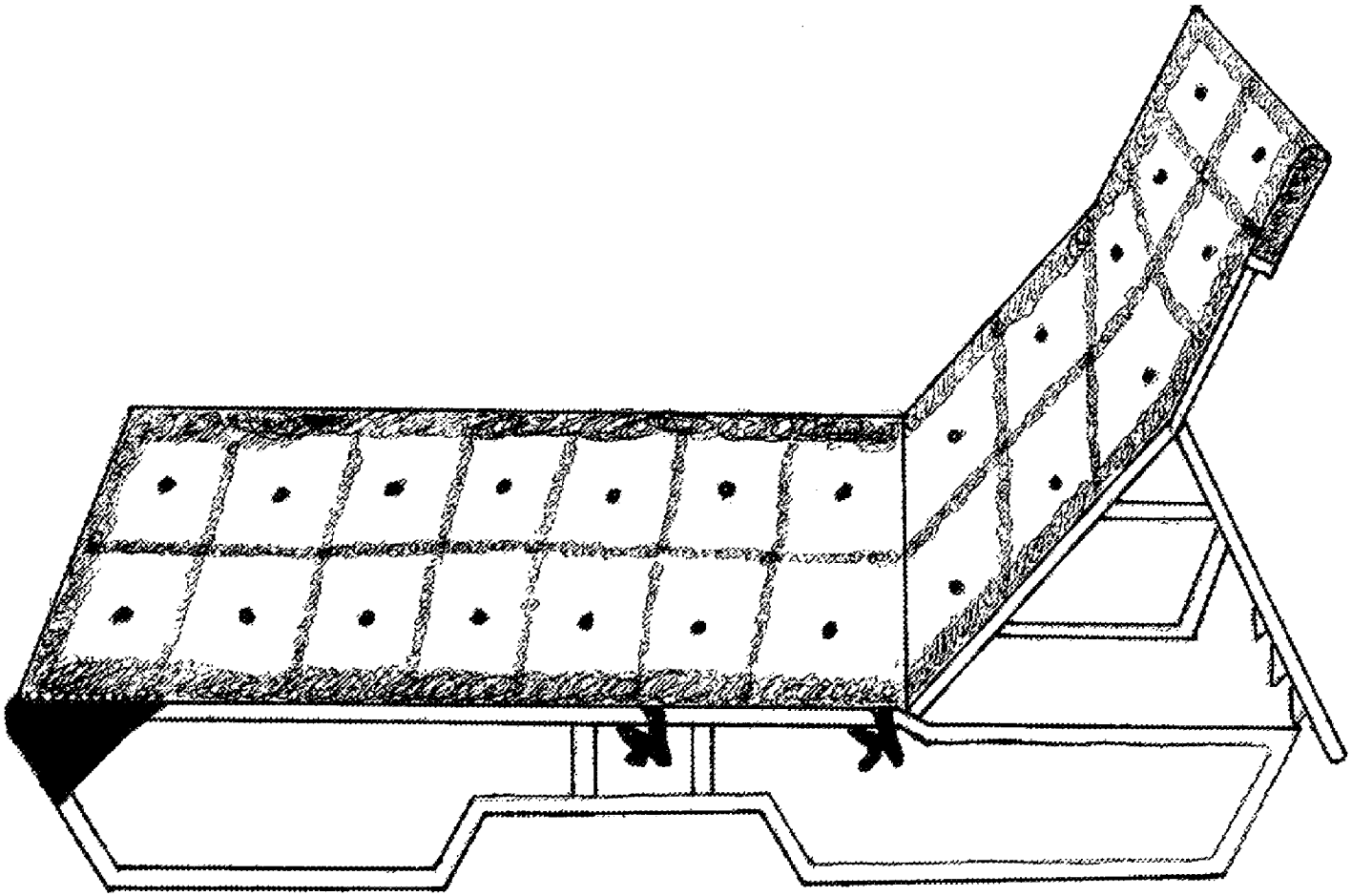
FIG. 7 shows a perspective view of the invention in an embodiment that has a pocket with drawstring at the head of the chair cover and adjustable fasteners at the foot of the chair cover.

FIG. 6 shows a side view, and FIG. 7 shows a perspective view, of the invention in an embodiment that has a pocket 31 with drawstring at one end and adjustable fasteners 33 at the opposite end.

The pocket of the chair cover 20 shown in FIGS. 6 and 7 is preferably fitted with a means of constricting the mouth of the pocket, such as elastic sewn to the pocket mouth, or a drawstring. A drawstring, especially one with a sliding barrel-lock, is preferred. After fitting the pocket around the frame of the chair 26, tightening the drawstring secures the chair cover more tightly to the chair frame. Lounge chairs that do not have a frame protruding from the point of attachment of the forward legs the chair, e.g., wooden deck chairs, frequently have a chair back that has a protruding frame. Therefore, in embodiments of the chair cover with a pocket at one end of the chair cover, the pocket is usually placed to envelop the top of the chair back; this places the adjustable fasteners at the chair foot, where the adjustable fasteners can secure the foot of the chair cover even though the chair lacks a protruding frame at the chair foot.

The discussion of the embodiments of the invention shown in FIGS. 5 to 7 that are directed to lounge chair covers, by changing the length and width of the main sheet to fit boating chairs, also serves as a detailed description of embodiments of the invention directed to boating chair covers.

All embodiments of the invention can optionally have fasteners along the longitudinal edges of the main sheet for attachment of accessories, such as head rests and pouches. A preferred fastener is hook-and-loop, though other fasteners known in the art, e.g., tie strings, buttoned strap and strap hole, button and buttonhole, snap fasteners, can be used. The fasteners at one or more places along the sides of the middle portion of the chair cover are used to secure the chair cover to the chair frame on the left and right sides of the chair. An optional reinforced perforation of the chair cover, provides a means of locking the chair cover to the chair.

In a third embodiment of the invention, the elastic brackets are affixed only to the longitudinal edge of the main sheet at a given corner, and not to the lateral end of the main sheet at that corner. Each elastic bracket has a hook-and-loop fastener affixed to the elastic bracket as described above, and a mating hook-and-loop fastener is affixed to the bottom of the lateral end of the main sheet at that corner. This embodiment is simpler to manufacture, but with a like-constructed second adjustable fastener at the opposite corner at the same lateral end, does not conform the end of the main sheet into an L shape. This third embodiment can secure one end of the chair cover to a lounge chair or to a boating chair, as described above, but without the benefit of completely covering the lateral end of the chair frame with the lateral end of the main sheet. In other words, this embodiment cannot provide a chair cover head or chair cover foot pocket like that provided if a lateral end of the main sheet is attached to two sides of the triangular elastic bracket, which attachment on two sides conforms that lateral end of a main sheet into an L shape before closure, whereby closure of the two adjustable fasteners at their respective corners at one lateral end creates a pocket at that lateral end of the main sheet.

Those skilled in the art should appreciate that they can readily use the description above as a basis for designing or modifying other structures for carrying out the same purposes of the present invention. Those skilled in the art should also realize that such equivalent constructions do not depart from the spirit and scope of the invention and of the claims.

I claim:

1. A chair cover comprising:

a substantially rectangular main sheet having a pair or longitudinal sides and a pair of lateral ends, a triangular shaped piece of stretch fabric attached to each of two corners at one end of the main sheet; each triangular shaped piece of stretch fabric having an edge attached along the longitudinal side of a respective corner of the main sheet such that the triangular shaped pieces extend outwardly from the longitudinal sides of the main sheet for wrapping around a member of the frame of the chair to secure the chair cover to the chair;

an adjustable fastener affixed near a bottom edge of a medial face of the corresponding triangular shaped pieces of stretch fabric, and a mating fastener affixed on an edge of a bottom surface of the lateral end of the main sheet at such corner disposed so as to engage the adjustable mating fastener on the medial face of the closest triangular shaped piece of stretch fabric; and a pocket at the opposite end of the main sheet for slipping over an end of the frame.

2. The chair cover of claim 1, wherein the length and width of the main sheet is chosen to fit chairs selected from a group consisting of lounge chairs, deck chairs, and boating chairs.

3. The chair cover of claim 1, wherein the main sheet is absorbent.

4. The chair cover of claim 1, wherein the fasteners affixed to the main sheet and to each of the triangular shaped piece of stretch fabric comprise hook-and- loop fasteners.

5. The chair cover of claim 1, wherein tab fasteners are disposed at one or more places along the longitudinal sides of a middle portion of the chair cover.

6. The chair cover of claim 1, wherein mating hook-and-loop tab fasteners are disposed at one or more places along the longitudinal sides of a middle portion of the chair cover.

7. The chair cover of claim 1, wherein the main sheet is a textile selected from a group comprising woven textile and non-woven textile

8. The chair cover of claim 1, wherein fasteners for accessories are disposed at one or more places along one or both longitudinal sides of the chair cover.

* * * * *